US011673224B2

(12) United States Patent
Kinoshita et al.

(10) Patent No.: US 11,673,224 B2
(45) Date of Patent: Jun. 13, 2023

(54) LIGHT TRANSMITTING MEMBER, POLISHING PAD, AND SUBSTRATE POLISHING APPARATUS

(71) Applicant: Ebara Corporation, Tokyo (JP)

(72) Inventors: Masaki Kinoshita, Tokyo (JP); Sachiko Takeda, Tokyo (JP); Chikako Koyama, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 386 days.

(21) Appl. No.: 16/404,940

(22) Filed: May 7, 2019

(65) Prior Publication Data

US 2019/0344399 A1 Nov. 14, 2019

(51) Int. Cl.
*B24B 37/013* (2012.01)
*B24B 37/20* (2012.01)

(52) U.S. Cl.
CPC ..... *B24B 37/205* (2013.01); *B24B 37/013* (2013.01)

(58) Field of Classification Search
CPC ..... B24B 37/205; B24B 37/013; B24B 49/12
USPC ..... 451/6, 41, 287
See application file for complete search history.

(56) References Cited

U.S. PATENT DOCUMENTS 2,490,950 A * 12/1949 Dryer ..... H01H 85/30 337/243
5,893,796 A 4/1999 Birang et al.
6,454,630 B1 9/2002 Tolles
6,716,085 B2 * 4/2004 Wiswesser ..... B24B 37/205 451/526
6,860,791 B2 3/2005 Birang et al.
6,916,225 B2 * 7/2005 Sugiyama ..... B24B 49/04 451/6
7,264,536 B2 9/2007 Wiswesser et al.
7,507,144 B2 * 3/2009 Hirokawa ..... B24B 37/013 156/345.16
7,942,724 B2 5/2011 Benvegnu et al.
8,475,228 B2 7/2013 Benvegnu et al.
8,562,389 B2 10/2013 Benvegnu et al.
2003/0129931 A1 * 7/2003 Konno ..... B24B 37/205 451/285
2003/0143925 A1 * 7/2003 Yang ..... B24B 37/205 451/6
2003/0171081 A1 9/2003 Komukai et al.
2004/0235393 A1 * 11/2004 Hirokawa ..... B24B 49/08 451/6
2006/0128271 A1 * 6/2006 Shiho ..... B24B 37/205 451/6

FOREIGN PATENT DOCUMENTS

JP 2010-528885 A 8/2010
JP 2013-082035 A 5/2013
JP 2013082035 A * 5/2013 ..... B24B 37/20
KR 10-2005-0056338 A 6/2005

* cited by examiner

*Primary Examiner* — Joel D Crandall
*Assistant Examiner* — Arman Milanian
(74) *Attorney, Agent, or Firm* — Venjuris, P.C.

(57) ABSTRACT

Disclosed is a light transmitting member for a polishing pad. The light transmitting member has a cylindrical or truncated conical shape, and a screw thread is formed on a side portion thereof. A polishing pad includes such a light transmitting member and a substrate polishing apparatus includes such a polishing pad.

12 Claims, 6 Drawing Sheets

LIGHT TRANSMITTING MEMBER, POLISHING PAD, AND SUBSTRATE POLISHING APPARATUS

CROSS REFERENCE TO RELATED APPLICATIONS

This application is based on and claims priority from Japanese Patent Application No. 2018-090094, filed on May 8, 2018, with the Japan Patent Office, the disclosure of which is incorporated herein in their entireties by reference.

TECHNICAL FIELD

The present disclosure relates to a light transmitting member, a polishing pad, and a substrate polishing apparatus.

BACKGROUND

In the related art, there has been known a substrate polishing apparatus which detects the progress of polishing via a light transmitting member formed on a polishing pad. The light transmitting member is formed to pass light from or to an optical sensor. For example, Patent Document 1 (Japanese Patent Application Publication No. 2010-528885) discloses a window formed on a polishing pad using a polyurethane polymer.

PRIOR ART

Patent Document

Patent Document 1: Japanese Patent Application Publication No. 2010-528885

SUMMARY

In the apparatus discloses in Patent Document 1, when the substrate polishing apparatus is driven, not only polishing of a substrate but also wear of a polishing pad and a light transmitting member occur. The wear of the polishing pad and the light transmitting member may be considered to be particularly remarkable at the time of dressing of the polishing pad. It may be considered that optical characteristics of the light transmitting member change when the wear of the light transmitting member occurs. For example, when the light transmitting member wears and the surface thereof is damaged, the light transmittance of the light transmitting member may decrease. Hereinafter, change in the optical characteristics of the light transmitting member due to wear is referred to as "deterioration of the light transmitting member." The deterioration of the light transmitting member may cause an error in measurement by the optical sensor.

For example, it may be considered that multiple scratches with random orientations and/or depths, for example, are generated on the surface of the light transmitting member. The generation of the scratches with random orientations and/or depths may cause the light transmittance of the light transmitting member to decrease over time, and the quality of detection data obtained by the optical sensor may become unstable. In addition, when the deterioration rate of the light transmitting member is faster than the wear rate of the polishing pad, there is a possibility that a large error occurs in measurement by the optical sensor although the polishing pad is still usable. The larger the error in measurement by an optical sensor, the more the polishing pad with the deteriorated light transmitting member may be considered to be no longer practical.

In Patent Document 1, the light transmitting member is formed by curing a liquid polymer in a hole in the polishing pad. In Patent Document 1, since the light transmitting member and the polishing pad are considered to be strongly bonded to each other at the time of curing the polymer, it is virtually impossible to separate the polishing pad and the light transmitting member from each other without damaging the polishing pad. Thus, when the light transmitting member is deteriorated before the polishing pad wears in Patent Document 1, it may be considered that the entire polishing pad needs to be replaced although the polishing pad is still usable. Replacement of the polishing pad that is still usable may shorten the replacement cycle of the polishing pad and may increase the running cost of the substrate polishing apparatus.

Accordingly, the present application is to provide a polishing pad having a novel configuration in order to solve at least some of the subjects described above.

The present application discloses, as an embodiment, a light transmitting member including two bottom surfaces, a side surface between the two bottom surfaces, and a screw thread formed on the side surface.

DETAILED DESCRIPTION

First Embodiment

<As for Outline of Substrate Polishing Apparatus 100>

Figure 1:
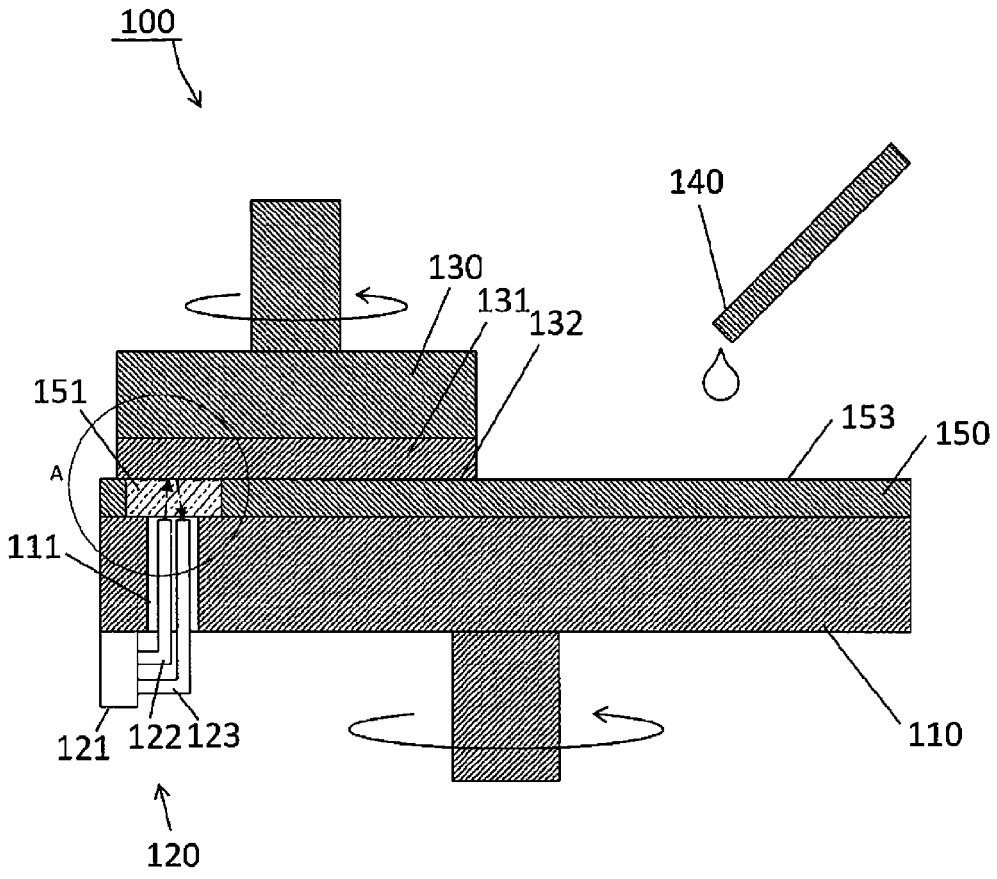
FIG. 1 is a front cross-sectional view of a substrate polishing apparatus.

FIG. 1 is a front cross-sectional view of a substrate polishing apparatus 100 according to a first embodiment. However, the drawings used for description in the present application are schematic views. The dimensions, shapes, and positions, for example, of elements represented in the respective drawings do not necessarily correspond to the dimensions, shapes, and positions, for example, of actual device elements.

The substrate polishing apparatus 100 of FIG. 1 is a chemical mechanical polishing (CMP) apparatus. The substrate polishing apparatus 100 may be an apparatus other than a CMP apparatus as long as the apparatus measures the progress of polishing with a detector from the lower surface of a polishing table. The substrate polishing apparatus 100 includes a polishing table 110, an optical sensor 120, a polishing head 130, and a polishing liquid supply mechanism 140. A polishing pad 150 is detachably attached to the upper surface of the polishing table 110. A substrate 131 is detachably attached to the lower surface of the polishing head 130. The substrate polishing apparatus 100 is capable of measuring the progress of polishing of the substrate 131 by the optical sensor 120 while polishing the substrate 131.

<As for Polishing Table 110>

The polishing table 110 is configured to be rotatable in at least one direction by, for example, a motor (not illustrated). The polishing table 110 may not be rotatable according to the type of the substrate polishing apparatus 100. The polishing table 110 is formed with a table opening 111 for passage of at least a portion of the optical sensor 120 and/or sensing light of the optical sensor 120. In addition, the "sensing light" refers to "incident light directed from the optical sensor 120 toward a polished surface 132 of the substrate 131" and "reflected light directed from the substrate 131 toward the optical sensor 120." Here, the "reflected light" mentioned herein refers to light generated by reflection of the incident light on the polishing surface 132 of the substrate 131. In addition, "the polished surface 132 of the substrate 131" refers to the surface of the substrate 131 to be polished, i.e., the surface of the substrate 131 to be in contact with the polishing pad 150.

<As for Optical Sensor 120>

The optical sensor 120 is a sensor for measuring the progress of polishing of the substrate 131. Specifically, the optical sensor 120 emits light to the polished surface 132 of the substrate 131 and measures optical characteristics of the reflected light. Since the optical characteristics of the reflected light may change according to the state of the polished surface 132 of the substrate 131, the progress of polishing may be measured by measuring the optical characteristics of the reflected light. The optical sensor 120 may be a sensor that measures the amount of polishing of the substrate 131. The optical sensor 120 may be a sensor that detects the end point of polishing of the substrate 131. In FIG. 1, one optical sensor 120 is provided near the edge of the polishing table 110. However, the number and position of optical sensors 120 are not limited to the example illustrated in FIG. 1. The optical sensor 120 of FIG. 1 is a non-liquid-sealed sensor. However, the optical sensor 120 may be liquid-sealed. As described later, when the optical sensor 120 is liquid-sealed, a light transmitting member 151 may be detached from the polishing pad 150.

The optical sensor 120 includes a sensor body 121, an incident light optical fiber 122, and a reflected light optical fiber 123. In FIG. 1, the sensor body 121 is provided on the underside of the polishing table 110. The sensor body 121 includes a light source (not illustrated) for emitting light toward the incident light optical fiber 122 and a photodetector (not illustrated) for measuring the reflected light that has passed through the reflected light optical fiber 123. The incident light optical fiber 122 and the reflected light optical fiber 123 extend from the sensor body 121. The incident light optical fiber 122 and the reflected light optical fiber 123 extend upward of the polishing table 110 from the underside of the polishing table 110 and reach the inside of the table opening 111. The positions of the upper ends of the incident light optical fiber 122 and the reflected light optical fiber 123 are slightly lower than the upper surface of the polishing table 110.

Wiring (not illustrated) may be formed to supply power to the sensor body 121 and to transmit a signal from the sensor body 121. The wiring may be connected to the sensor body 121 via a rotary joint (not illustrated). The signal from the sensor body 121 may be received by a controller (not illustrated). By adopting, for example, a wireless transmission technology, the formation of the wiring may be omitted. The controller which has received a signal from the sensor body 121 indicating that "the substrate 131 has been polished by a predetermined amount" or "the polishing of the substrate 131 has reached the end point" may stop the polishing of the substrate 131 by controlling the substrate polishing apparatus 100 so as to execute at least one step among the following steps (1) to (4) of: (1) lifting the polishing head 130; (2) stopping rotation of the polishing head 130; (3) stopping rotation of the polishing table 110; and (4) stopping supply of a polishing liquid from the polishing liquid supply mechanism 140.

In addition, the configuration of the optical sensor 120 is merely illustrative. Other configurations of the optical sensor 120 may be used. For example, the optical sensor 120 may include a greater number of optical fibers. A fixed head for fixing the incident light optical fiber 122 and the reflected light optical fiber 123 may be provided. A nozzle may be provided at the tip of each of the incident light optical fiber 122 and the reflected light optical fiber 123 in order to correctly guide light from or to each fiber.

<As for Polishing Head 130>

The polishing head 130 is provided above the polishing table 110 so as to face the polishing table 110. The substrate 131 is detachably attached to the lower surface of the polishing head 130. The polishing head 130 is configured to be rotatable in at least one direction, more particularly, in the same direction as the rotation direction of the polishing table 110, for example, by a motor (not illustrated). The polishing head 130 is configured to be vertically movable, for example, by a vertical movement mechanism (not illustrated). When the polishing head 130 is lowered by the vertical movement mechanism, the substrate 131 is pressed against the polishing pad 150. The substrate 131 is polished when any one of the polishing head 130 and the polishing table 110, more particularly, both the two are rotated in a state where the substrate 131 is pressed against the polishing pad 150.

<As for Polishing Liquid Supply Mechanism 140>

The polishing liquid supply mechanism 140 is provided above the polishing table 110. The tip of the polishing liquid supply mechanism 140 is in the form of a nozzle and is capable of supplying a polishing liquid (slurry), for example, toward the polishing pad 150. The polishing liquid supply mechanism 140 may supply a cleaning liquid and/or a chemical solution without being limited to the polishing liquid. Unlike the configuration of FIG. 1, a configuration in which the polishing liquid is supplied from the lower surface of the polishing table 110 or a configuration in which the polishing liquid is supplied from the inside of the polishing head 130 may be employed.

<As for Polishing Pad 150>

The polishing pad 150 is a plate-shaped member attached to the upper surface of the polishing table 110. In addition, the polishing pad 150 may be expressed as a "cloth-shaped member" according to the material and thickness of the polishing pad 150. In general, the polishing pad 150 is formed of an opaque material (e.g., polyurethane foam). Here, the surface of the polishing pad 150 to be in contact with the substrate 131 is referred to as "a polishing surface 153 of the polishing pad 150."

The light transmitting member 151 is formed on the polishing pad 150 to transmit the sensing light. The light transmitting member 151 is formed so as to be positioned above the table opening 111 when the polishing table 110 is correctly attached to the polishing pad 150. When a plurality of optical sensors 120 and table openings 111 for the optical sensors 120 are provided, a plurality of light transmitting members 151 may also be formed.

The light transmitting member 151 is substantially transparent with respect to at least a wavelength range of the sensing light. The material of the light transmitting member 151 may be, for example, polycarbonate resin, acrylic resin, polyvinyl chloride resin, polystyrene resin, polyurethane resin, or polyester resin. Although not limited to this, as an example, the light transmitting member 151 may have light transmittance of 80% or more with respect to light having a wavelength range of 400 nm or more and 410 nm or less. The light transmitting member 151 may have any shape such as a circular shape, an elliptical shape, or a square shape as viewed from above. As described later, when the light transmitting member 151 has a screw thread 200, the light transmitting member 151 may be substantially cylindrical (circular as viewed from above) or substantially truncated conical.

<As for Details of Light Transmitting Member 151>

Figure 2:
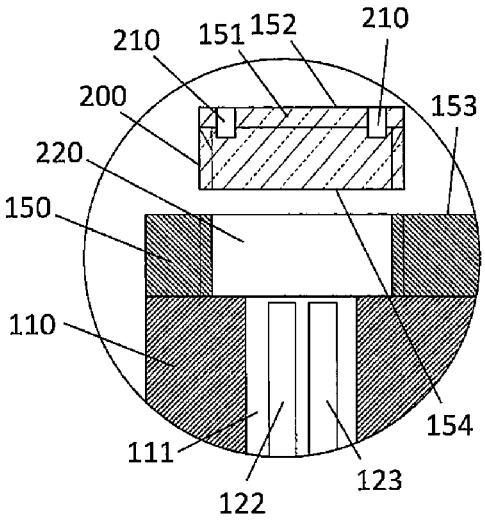
FIG. 2 is an enlarged view of a polishing table and a polishing pad illustrating a state where a light transmitting member is detached from the polishing pad.
Figure 3:
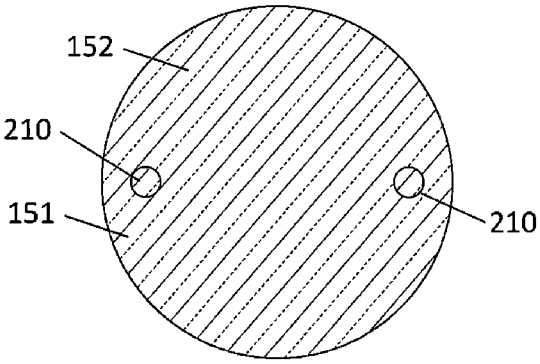
FIG. 3 is a top view of the light transmitting member.

Details of the light transmitting member 151 will be described with reference to FIGS. 2 and 3. FIG. 2 is an enlarged view of the polishing table 110 and the polishing pad 150. In FIG. 2, the region corresponding to the region labeled "A" in FIG. 1 is enlarged. The light transmitting member 151 is illustrated as being detached from the polishing pad 150. FIG. 3 is a top view of the light transmitting member 151.

The light transmitting member 151 according to an embodiment includes two bottom surfaces (an upper surface 152 and a lower surface 154, where the terms "upper" and "lower" herein merely represent the directions for convenience, that is, the direction in which the upper surface 152 is located may not necessarily be a vertically upward direction), more specifically, two parallel bottom surfaces, and a side surface between the two parallel bottom surfaces. In the example of FIGS. 2 and 3, the light transmitting member 151 is substantially cylindrical (circular as viewed from above) or substantially truncated conical. When the light transmitting member 151 is substantially truncated conical, the light transmitting member 151 may be in the form of a truncated cone formed by cutting a right cone. In other words, when the light transmitting member 151 is substantially truncated conical, the light transmitting member 151 may have a property as a rotating body. However, the above disclosure describes the shape of the light transmitting member 151 but does not describe the manufacturing process of the light transmitting member 151. That is, the light transmitting member 151 may be manufactured by actually cutting out a conical material, may be manufactured by injection molding, for example, or may be manufactured by any other manufacturing process. The screw thread 200 is formed on the side surface of the light transmitting member 151. Thus, when the light transmitting member 151 has a truncated conical shape, the light transmitting member 151 substantially functions as a tapered screw. In order to insert the tip of a tool (e.g., a screwdriver-shaped tool) for attachment of the light transmitting member 151, at least one bottom surface of the light transmitting member 151 (the bottom surface located in the upward direction in FIG. 2) is formed with a recess 210. In the example of FIG. 2, the recess 210 is formed on the surface 152 of the light transmitting member 151 that faces the substrate 131. When the light transmitting member 151 is substantially truncated conical, the recess 210 may be formed in the surface having a larger area among the two bottom surfaces. The formation of the recess 210 facilitates the attachment and detachment of the light transmitting member 151. Here, the recess 210 is a pin hole. In the light transmitting member 151 of FIGS. 2 and 3, two recesses 210 are concentrically formed. The number of recesses 210 is arbitrary. The recess 210 (e.g., a slit) other than the pin hole may be used. The recess 210 may be formed near the edge of the light transmitting member 151 so as not to block the sensing light. For example, the distance between the recess 210 and the center axis of the light transmitting member 151 is a half or more of the radius of the light transmitting member 151. In addition, as described above, the light transmitting member 151 in the example of FIGS. 2 and 3 is substantially cylindrical or substantially truncated conical. Thus, the "center axis of the light transmitting member 151" is naturally set.

A screw hole 220 corresponding to the screw thread 200 is formed in a portion of the polishing pad 150 to which the light transmitting member 151 is to be attached. The screw hole 220 penetrates the polishing pad 150. Only a portion of the screw hole 220 may be formed by screw cutting. By screwing the light transmitting member 151 into the screw hole 220, the light transmitting member 151 may be easily attached to the polishing pad 150. Similarly, the light transmitting member 151 may be easily detached from the polishing pad 150.

In a case of using the light transmitting member 151 formed with the screw thread 200, it may be necessary to position the light transmitting member 151 in the longitudinal direction. The light transmitting member 151 may be positioned by any means known in the art for use in the positioning of a screw-shaped member. For example, the light transmitting member 151 may be positioned by forming the light transmitting member 151 in a bolt shape and forming a counterbore around the screw hole 220.

Figure 4:
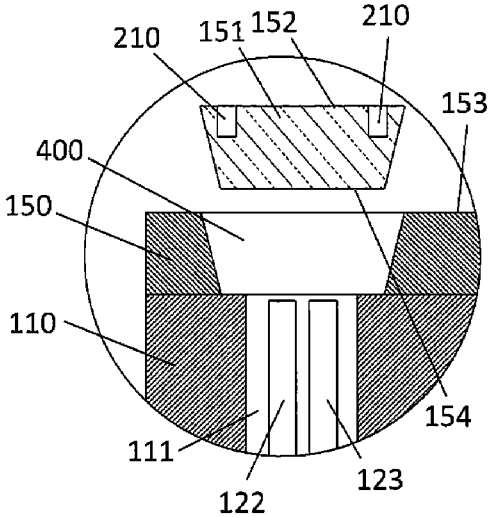
FIG. 4 is an enlarged view of the polishing table and the polishing pad for illustrating a tapered light transmitting member in a state where the light transmitting member is detached from the polishing pad.

A configuration of the light transmitting member 151 is not limited to the configuration illustrated in FIGS. 2 and 3. FIG. 4 is an enlarged view of the polishing table 110 and the polishing pad 150 for illustrating the light transmitting member 151 according to a modification. The enlarged region in FIG. 4 is equivalent to that in FIG. 2. The light transmitting member 151 of FIG. 4 is provided with the surface 152 that faces the substrate 131. The light transmitting member 151 in FIG. 4 has a shape in which the cross-sectional area thereof in a plane parallel to the surface 152 that faces the substrate 131 increases towards the surface 152. In other words, the shape of the light transmitting member 151 in FIG. 4 is a tapered shape in which the cross section thereof is tapered in a direction opposite to the direction toward the surface 152 (a downward direction in FIG. 4). As long as the cross section has a tapered shape, the light transmitting member 151 may be circular or rectangular as viewed from above, or may be arc-shaped in the circumferential direction of the polishing pad 150. The light transmitting member 151 may have a tapered cross section in the radial direction of the polishing table 110. The light transmitting member 151 may have a tapered cross section in the circumferential direction of the polishing table 110.

The screw hole 220 is not formed in the polishing pad 150. Alternatively, the polishing pad 150 is formed with a hole 400 having a shape in which the area of the hole in a plane parallel to the polishing surface 153 of the polishing pad 150 increases towards the polishing surface 153 of the polishing pad 150 so as to correspond to the shape of the light transmitting member 151. In other words, the hole 400 is a tapered hole (and thus, the hole 400 may be referred to as a "tapered hole 400"). The recess 210 (pin hole) for inserting the tip of a tool (e.g., a tweezer-shaped tool) for attaching the light transmitting member 151 is formed in the surface 152 of the light transmitting member 151 that faces the substrate 131. When the light transmitting member 151 of FIG. 4 is inserted into the tapered hole 400, the light transmitting member 151 stops at a predetermined position. Thus, when the light transmitting member 151 of FIG. 4 is used, it is not necessary to position the light transmitting member 151 in the longitudinal direction. On the other hand, the light transmitting member 151 of FIG. 4 may be easily pulled upward. Thus, the light transmitting member 151 of FIG. 4 may also be easily detached from the polishing pad 150. The light transmitting member 151 of FIG. 4 is advantageously easily attached and detached as compared with the light transmitting member 151 of FIG. 2. On the other hand, the light transmitting member 151 of FIG. 2 is advantageously firmly fixed to the polishing pad 150 as compared with the light transmitting member 151 of FIG. 4.

By using the light transmitting member 151 (FIG. 2) having the screw thread 200 (FIG. 2) or the light transmitting member having a tapered cross section (FIG. 4), replacement of the light transmitting member 151 becomes possible. Thus, even if the light transmitting member 151 is deteriorated, it is not necessary to replace the entire polishing pad 150. Thus, by using the light transmitting member 151 described in the present application, the replacement cycle of the polishing pad 150 may be prolonged. As a result, the running cost of the substrate polishing apparatus 100 may be reduced.

The polishing pad 150 according to the present embodiment may be applied to both the substrate polishing apparatus 100 having the non-liquid-sealed optical sensor 120 and the substrate polishing apparatus 100 having the liquid-sealed optical sensor 120. The corresponding effects will be described below.

Generally, in a case of using a liquid-sealed optical sensor, it is necessary to form an opening in a polishing pad to allow a liquid to flow toward the lower surface of a substrate through the opening. On the other hand, in a case of using a non-liquid-sealed optical sensor, it is necessary to form a light transmitting member on a polishing pad. Conventional light transmitting members were not separable from the polishing pad. Since it is impossible for a liquid to pass through the light transmitting member, it is impossible to flow the liquid toward the substrate through the light transmitting member. Thus, the conventional polishing pad formed with the light transmitting member is not suitable for a substrate polishing apparatus having a liquid-sealed optical sensor.

The polishing pad 150 according to the present embodiment is configured to enable attachment and detachment of the light transmitting member 151. When the light transmitting member 151 is detached, the screw hole 220 or the tapered hole 400 functions as an opening for flowing a liquid. Thus, the polishing pad 150 according to the present embodiment may be applied to both the substrate polishing apparatus 100 having the non-liquid-sealed optical sensor 120 and the substrate polishing apparatus 100 having the liquid-sealed optical sensor 120.

Second Embodiment

<Outline of Second Embodiment>

In a general substrate polishing apparatus, a polishing pad is a consumable item. In a conventional substrate polishing apparatus, the maximum number of use times or the longest use time of the polishing pad has been set based on the amount of wear measured or calculated in advance. That is, in the conventional substrate polishing apparatus, when the polishing pad has been used for a predetermined number of times or for a predetermined time (hereinafter simply referred to as "predetermined number of times"), it has been determined that the lifespan of the polishing pad has expired. However, it cannot be said that the lifespan of the polishing pad just ends when the polishing pad has been used a predetermined number of times. When the lifespan of the polishing pad has expired before the polishing pad has been used a predetermined number of times, the substrate is polished by the polishing pad after the lifespan thereof is over. Thus, there is a possibility that the substrate polishing apparatus may not exhibit predetermined polishing performance. On the other hand, when the lifespan of the polishing pad has not expired even after the polishing pad has been used a predetermined number of times, the polishing pad that is still usable will be replaced. Replacement of the polishing pad that is still usable shortens the replacement cycle of the polishing pad and increases the cost required for replacement.

Figure 5:
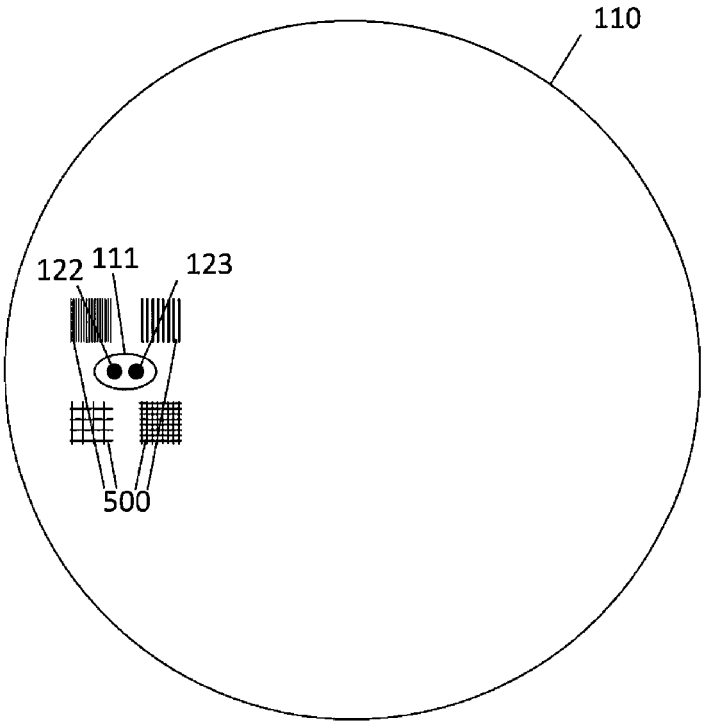
FIG. 5 is a top view of the polishing table having indicators.

In order to solve the above subject, in the second embodiment, the substrate polishing apparatus 100 having indicators on the polishing table 110 will be described. FIG. 5 is a top view of the polishing table 110 having indicators 500.

<As for Indicator 500>

At least some of the indicators 500 are provided in a region of the polishing table 110 which is located immediately below the light transmitting member 151 of the polishing pad 150 when the polishing pad 150 is correctly attached. In other words, the indicators 500 are provided at a position at which the indicators 500 are visible through the light transmitting member 151 when the polishing pad 150 is correctly attached.

In FIG. 5, four types of patterns (a narrow spacing striped pattern, a wide spacing striped pattern, a narrow spacing lattice pattern, and a wide spacing lattice pattern) form a set of indicators 500. However, a specific configuration of the indicators 500 is not limited to the configuration illustrated in FIG. 5 as long as deterioration of the light transmitting member 151 may be confirmed. For example, the indicators 500 may form any number of patterns. In the simplest example, the indicators 500 may be just points. The indicators 500 are configured to be visible to a user of the substrate polishing apparatus 100. However, when, for example, any imaging device observes the indicators 500 in place of the user, the indicators 500 may be invisible to the user as long as the indicators 500 are visible to the imaging device. The indicators 500 may be formed by any method such as, for example, laser marking, painting, printing, or marking-off.

Figure 6A:
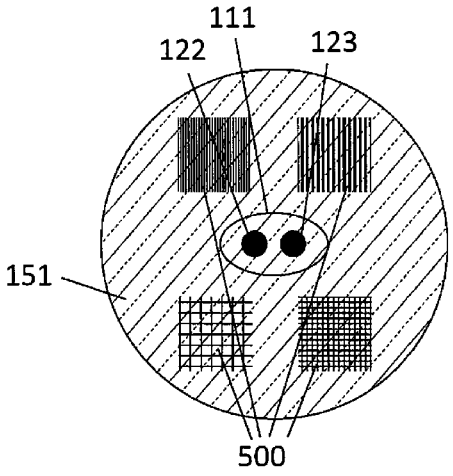
FIG. 6A is a view illustrating the indicators observed through the light transmitting member that is not deteriorated.
Figure 6B:
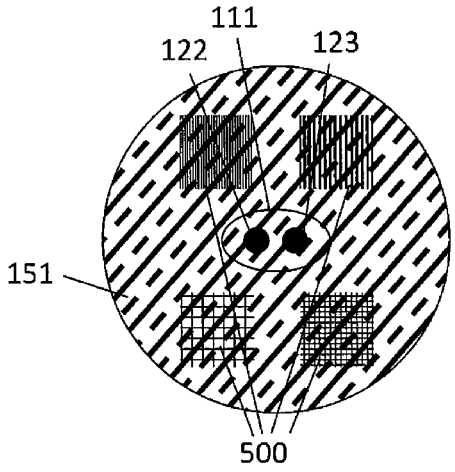
FIG. 6B is a view illustrating the indicators observed through the deteriorated light transmitting member.

When the substrate polishing apparatus 100 is driven, the light transmitting member 151 may be deteriorated. It may be considered that what kind of optical characteristics change due to deterioration depends on, for example, a specific process, the type of a used polishing liquid, the material of the substrate 131, the material of the light transmitting member 151, and the material of a dresser. Here, it is assumed that the light transmittance of the light transmitting member 151 is lowered. FIGS. 6A and 6B are views illustrating the indicators 500 observed through the light transmitting member 151 of the polishing pad 150. FIG. 6A is a view in a case where the light transmitting member 151 has not been deteriorated. FIG. 6B is a view in a case where the light transmitting member 151 has been deteriorated. In addition, in FIGS. 6A and 6B, the light transmittance of the light transmitting member 151 is indicated by the thickness of hatching of the light transmitting member 151. Specifically, the thicker the hatching, the lower the light transmittance of the light transmitting member 151.

The deterioration of the light transmitting member 151 also causes change in the appearance of the indicator 500 when observed through the light transmitting member 151. For example, in FIG. 6B, since the light transmittance of the light transmitting member 151 is lowered, it is difficult to view the indicator 500. As such, the deterioration of the light transmitting member 151 may be grasped from change in the appearance of the indicator 500. Since the deterioration of the light transmitting member 151 occurs simultaneously with the wear of the polishing pad 150, it is possible to indirectly grasp the amount of wear of the polishing pad 150 by grasping the deterioration of the light transmitting member 151. It is possible to replace the polishing pad 150 at an appropriate timing by grasping the amount of wear of the polishing pad 150.

The timing of replacement of the polishing pad 150 may be determined, for example, based on at least one of the following parameters: (1) the brightness of the indicator 500; (2) the sharpness of an edge portion of the indicator 500; (3) the contrast ratio between a predetermined point of the indicator 500 and other points (regardless of the inside or outside of the indicator 500); and (4) the color tone of the indicator 500 when the indicator 500 is observed through the light transmitting member 151. In a case where the indicator 500 has a pattern (e.g., a striped pattern or a lattice pattern) formed by repetition of a predetermined shape, the timing of replacing the polishing pad 150 may be determined according to (5) whether or not any shape may be distinguished from a shape therearound, that is, whether or not the pattern of the indicator 500 may be determined when the indicator 500 is observed through the light transmitting member 151. In addition, the above parameters (1) to (5) are merely illustrative. When making a determination based on the above parameters (1) to (5), a threshold may be set as appropriate. For example, the polishing pad 150 may be replaced at any timing from the time point when the user may not distinguish one type of pattern (e.g., a narrow spacing lattice pattern) of the indicators 500 to the time point when the user may not distinguish all patterns of the indicators 500. The timing of replacing the polishing pad 150 may be determined whether or not the user views the indicators 500. On the other hand, when the substrate polishing apparatus 100 includes any imaging mechanism, the indicators 500 may be observed by the imaging mechanism. When the indicators 500 are observed by the imaging mechanism, the timing of replacing the polishing pad 150 may be determined by any image processing technology known in the art.

According to the configuration described above, the polishing pad 150 may be replaced at an appropriate timing. In addition, once the indicator 500 has been viewed, the amount of wear of the polishing pad 150 may be grasped substantially in real time.

Third Embodiment

<Outline of Third Embodiment>

Hereinafter, another configuration for fixing the light transmitting member 151 to the polishing pad 150 will be described. A configuration of the substrate polishing apparatus 100, for example, according to a third embodiment is the same as the configuration described in the first embodiment except for the shape of the light transmitting member 151, the characteristics of the hole in the polishing pad 150 (the screw hole 220 being replaced with a through-hole 710), a counterbored portion 720, a fixture 730, and a fixture receiving hole 740. However, for convenience of illustration, the shape of each part illustrated in FIG. 7 may be different from the shape illustrated in the other drawings.

<As for Shape of Light Transmitting Member>

Figure 7:
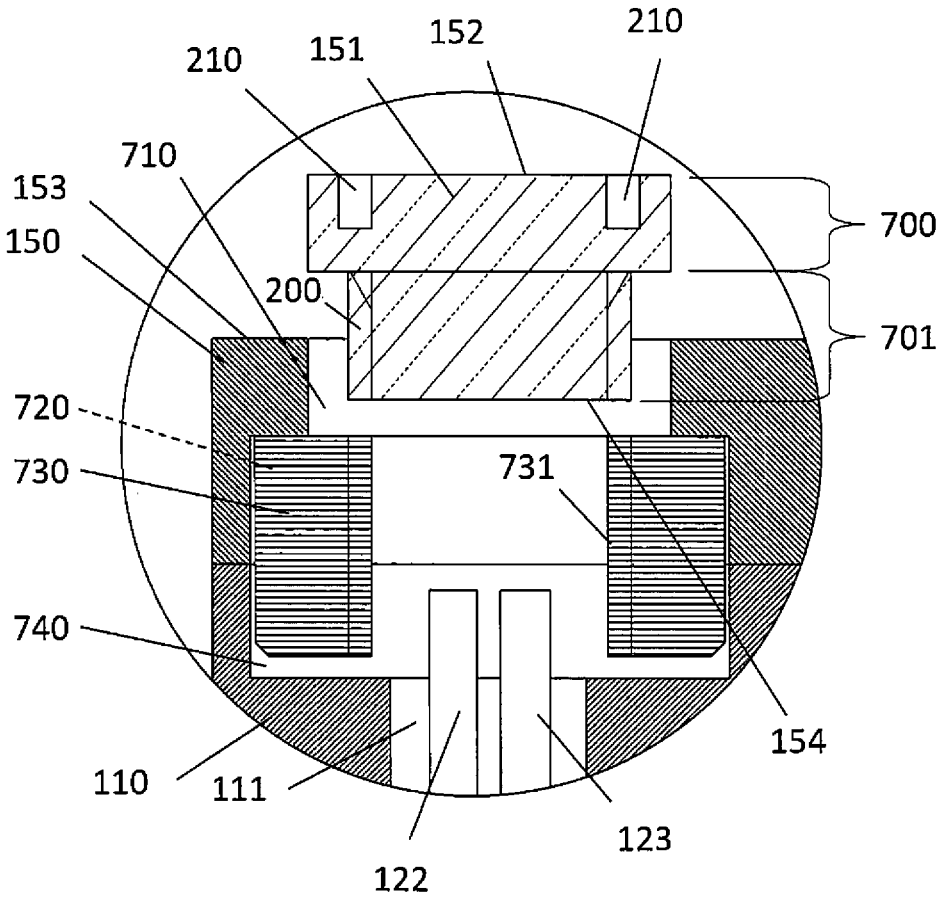
FIG. 7 is a view illustrating a light transmitting member according to a third embodiment.

The light transmitting member 151 of FIG. 7 includes a head portion 700 and a shaft portion 701. The shaft portion 701 is formed with the screw thread 200. In the present embodiment, the light transmitting member 151 is fixed by engaging the fixture 730 to be described later with the shaft portion 701. Thus, unlike a case where the light transmitting member 151 of FIG. 2 is fixed, it is not necessary to rotate the light transmitting member 151 when the light transmitting member 151 of FIG. 7 is fixed. Thus, the shape of the light transmitting member 151 of FIG. 7 as viewed from above may be a shape other than a circle, for example, a polygon, an ellipse, or any other shape.

<As for Polishing Pad 150>

The polishing pad 150 of FIG. 7 is formed with the through-hole 710 into which the light transmitting member 151 is inserted. The through-hole 710 has a shape corresponding to the shape of the light transmitting member 151, in particular, the shape of the head portion 700. The counterbored portion 720 is formed around the through-hole 710. The counterbored portion 720 is formed in the surface of the polishing pad 150 that faces the polishing table 110. The counterbored portion 720 is configured to receive at least a portion of the light transmitting member 151 when the light transmitting member 151 is fixed by the fixture 730 to be described later. In addition, a dotted line extending from the reference numeral "720" in FIG. 7 indicates that the counterbored portion 720 is hidden by the fixture 730. The depth of the counterbored portion 720 may be determined by the dimensions of the fixture 730 to be described later and the fixture receiving hole 740. In an extreme case, the depth of the counterbored portion 720 may be zero. In other words, the counterbored portion 720 may not exist.

<As for Fixture 730>

The fixture 730 is a member that is engaged with the screw thread 200 of the light transmitting member 151, more specifically, with the screw thread 200 of the shaft portion 701. Thus, the fixture 730 is formed with a screw hole 731. The fixture 730 may be, for example, a nut. The light transmitting member 151 is fixed by rotating the fixture 730 to engage the screw hole 731 with the screw thread 200. At the time of this fixing, it is not necessary to rotate the light transmitting member 151. However, when the head portion 700 of the light transmitting member 151 is circular as viewed from above, the light transmitting member 151 may be rotated.

<As for Fixture Receiving Hole 740>

The fixture 730 may be embedded inside the polishing pad 150 when the depth of the counterbored portion 720 is equal to or longer (deeper) than the height of the fixture 730. In such a case, it is difficult to rotate the fixture 730 and tighten the screw. Thus, the depth of the counterbored portion 720 may be shorter (shallower) than the height of the fixture 730. However, when, for example, a jig is used, the depth of the counterbored portion 720 may be equal to or longer (deeper) than the height of the fixture 730. Thus, a portion of the fixture 730 may protrude from the polishing pad 150. Thus, the fixture receiving hole 740 for receiving a protruding portion of the fixture 730 is formed in the polishing table 110 of FIG. 7. The fixture receiving hole 740 of FIG. 7 is a blind hole.

When the screw is tightened, the vertical movement of the light transmitting member 151 is limited by a contact portion thereof with the bottom surface of the counterbored portion 720 and the bottom surface of the fixture receiving hole 740. However, in the configuration of FIG. 7, a gap exists between the fixture 730 and the bottom surface of the fixture receiving hole 740. Thus, the light transmitting member 151 may move up and down by the size of the gap. In addition, in the present specification, as long as the light transmitting member 151 may be sufficiently prevented from being separated from the polishing pad 150 during polishing of the substrate, it is assumed that the light transmitting member 151 is "fixed" even when the light transmitting member 151 may move. When it is desired to suppress the vertical movement of the light transmitting member 151 as much as possible, the size of the gap between the fixture 730 and the fixture receiving hole 740 may be reduced. In extreme terms, the vertical movement of the fixture 730 may be prevented by configuring each part so that the length of the gap is zero, that is, there is no gap. In addition, for example, the cross section of the head portion 700 and the through-hole 710 may be formed in a trapezoidal shape to suppress the vertical movement of the fixture 730. As still another example, the vertical movement of the fixture 730 may be suppressed by configuring each part so that a portion of the polishing pad 150 is sandwiched between the head portion 700 and the fixture 730 when the light transmitting member 151 is fixed. The movement of the light transmitting member 151 in the transverse direction and in the depth or forward direction is restricted by a contact portion between the side surface of the head portion 700 and the side surface of the through-hole 710.

As described above, the light transmitting member 151 may also be fixed by the configuration of the third embodiment. The user of the substrate polishing apparatus 100 may replace the light transmitting member 151 by removing a part or the entirety of the polishing pad 150 from the polishing table 110.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

The present application discloses, as an embodiment, a light transmitting member detachably attached to a polishing pad of a polishing apparatus capable of measuring progress of polishing of a substrate while polishing the substrate, the light transmitting member including two bottom surfaces and a side surface between the two bottom surfaces, the light transmitting member further including a screw thread formed on the side surface thereof, and the light transmitting member being capable of transmitting incident light for measuring the progress of the polishing of the substrate and reflected light generated by reflection of the incident light on a polished surface of the substrate. In addition, the present application discloses, as an embodiment, a light transmitting member having a cylindrical or truncated conical shape. Moreover, the present application discloses, as an embodiment, a light transmitting member detachably attached to a polishing pad of a polishing apparatus capable of measuring progress of polishing of a substrate while polishing the substrate, the light transmitting member including a surface facing the substrate, the light transmitting member being capable of transmitting incident light for measuring the progress of the polishing of the substrate and reflected light generated by reflection of the incident light on a polished surface of the substrate, and the light transmitting member having a shape in which a cross-sectional area thereof in a plane parallel to the surface facing the substrate increases towards the surface facing the substrate. Such a light transmitting member has the effect of being removable from the polishing pad as an example.

Moreover, the present application discloses, as an embodiment, a light transmitting member in which a recess for inserting a tip of a tool for attaching the light transmitting member is formed in at least one bottom surface of the light transmitting member. In addition, the present application discloses, as an embodiment, a light transmitting member in which a recess for inserting a tip of a tool for attaching the light transmitting member is formed in a surface facing a substrate. These light transmitting members exert an effect of being easily attached and detached by the tool as an example.

In addition, the present application discloses, as an embodiment, a light transmitting member in which a distance between a recess and a center axis of the light transmitting member is longer than a half of a radius of the light transmitting member. The light transmitting member exerts an effect of not blocking sensing light as an example.

Moreover, the present application discloses, as an embodiment, a polishing pad including a light transmitting member formed with a screw thread on a side surface thereof and a screw hole corresponding to the screw thread of the light transmitting member. In addition, the present application discloses, as an embodiment, a polishing pad including a light transmitting member having a shape in which a cross-sectional area thereof in a plane parallel to a surface facing a substrate increases towards the surface facing the substrate and a hole corresponding to the shape of the light transmitting member, the hole being shaped such that an area of the hole in a plane parallel to a polishing surface of the polishing pad increases towards the polishing surface. These disclosures provide details of the polishing pad to which a progressive light transmitting member is applied.

In addition, the present application discloses, as an embodiment, a substrate polishing apparatus including any one polishing pad described in the present specification, a polishing table to which the polishing pad is attached, and a polishing head provided to face the polishing table for attaching a substrate. This disclosure provides details of the substrate polishing apparatus to which a progressive polishing pad is applied.

In addition, the present application discloses, as an embodiment, a polishing pad for a substrate polishing apparatus, the polishing pad including a screw hole for attaching a light transmitting member or a hole shaped such that an area of the hole in a plane parallel to a polishing surface of the polishing pad increases towards the polishing surface. The polishing pad exerts an effect of enabling attachment of any one light transmitting member described in the present specification. Moreover, the present application discloses, as an embodiment, a substrate polishing apparatus including such a polishing pad, a polishing table to which the polishing pad is attached, and a polishing head provided to face the polishing table for attaching a substrate. This disclosure provides details of the substrate polishing apparatus to which a progressive polishing pad is applied.

DESCRIPTION OF SYMBOL

100 Substrate polishing apparatus
110 Polishing table
111 Table opening

120 Optical sensor
121 Sensor body
122 Incident light optical fiber
123 Reflected light optical fiber
130 Polishing head
131 Substrate
132 Polished surface of substrate
140 Polishing liquid supply mechanism
150 Polishing pad
151 Light transmitting member
152 Surface that faces the substrate (of the light transmitting member) (Surface (upper surface) of the two bottom surfaces)
153 Polishing surface of polishing pad
154 Surface (lower surface) of the two bottom surfaces
200 Screw thread
210 Recess
220 Screw hole
400 Tapered hole
500 Indicator
700 Head portion
701 Shaft portion
710 Through-hole
720 Counterbored portion
730 Fixture
731 Screw hole
740 Fixture Receiving hole

What is claimed is:

1. A light transmitting member comprising:

a head forming an upper surface having a first diameter and a shaft forming a lower surface having a second diameter opposite the upper surface; and a screw thread formed on the shaft, the screw thread extending from the lower surface to the head of the light transmitting member, wherein the light transmitting member is detachably attached to a polishing pad of a polishing apparatus through a through-hole of the polishing pad having an opening in a polishing surface of the polishing pad facing a substrate, the polishing apparatus being capable of measuring a progress of polishing of the substrate while polishing the substrate, the light transmitting member is configured to transmit incident light for measuring the progress of the polishing of the substrate and reflected light generated by reflection of the incident light on a polished surface of the substrate, the screw thread is configured to engage with a fixture embedded in a counterbored portion formed around the through-hole of the polishing pad, and the first diameter of the upper surface is larger than the second diameter of the lower surface of the light transmitting member.

2. The light transmitting member according to claim 1, wherein the head of the light transmitting member has a cylindrical or truncated conical shape.

3. The light transmitting member according to claim 1, wherein the upper surface of the light transmitting member is formed with a recess to insert a tip end of a tool for attaching the light transmitting member.

4. The light transmitting member according to claim 3, wherein the head of the light transmitting member has a cylindrical or truncated conical shape, and a distance between the recess and a center axis of the light transmitting member is longer than a half of a radius of the light transmitting member.

5. A polishing pad for a substrate polishing apparatus, the polishing pad comprising:

the light transmitting member according to claim 1; and a screw hole positioned in the fixture and corresponding to the screw thread of the light transmitting member.

6. A substrate polishing apparatus comprising:

the polishing pad according to claim 5;

a polishing table to which the polishing pad is attached; and a polishing head configured to be attached to the substrate.

7. The light transmitting member according to claim 1, wherein the lower surface of the light transmitting member does not extend beyond a lower surface of the polishing pad.

8. The substrate polishing apparatus according to claim 6, wherein the polishing head is configured to move the substrate relative to the polishing pad.

9. The substrate polishing apparatus according to claim 6, wherein the lower surface of the light transmitting member contacts a top surface of the polishing table.

10. The light transmitting member according to claim 1, wherein the light transmitting member is substantially transparent with respect to at least a wavelength range of the incident light.

11. The light transmitting member according to claim 1, wherein a material of the light transmitting member is one of a polycarbonate resin, an acrylic resin, a polyvinyl chloride resin, a polystyrene resin, a polyurethane resin, and a polyester resin.

12. A substrate polishing apparatus comprising:

the polishing pad according to claim 5; and a polishing table to which the polishing pad is attached, wherein the polishing table includes a table opening upon which the light transmitting member is positioned, the light transmitting member having a diameter larger than a diameter of the table opening.

* * * * *